US006470713B1

(12) United States Patent
Lamprillo

(10) Patent No.: US 6,470,713 B1
(45) Date of Patent: Oct. 29, 2002

(54) METHOD AND APPARATUS FOR MONITORING RUN/STOP CONDITIONS OF A YARN

(75) Inventor: Stefano Lamprillo, Biella (IT)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 09/914,820

(22) PCT Filed: Mar. 1, 2000

(86) PCT No.: PCT/EP00/01768

§ 371 (c)(1),
(2), (4) Date: Jan. 23, 2002

(87) PCT Pub. No.: WO00/51928

PCT Pub. Date: Mar. 1, 2000

(30) Foreign Application Priority Data

Mar. 3, 1999 (SE) ..... 9900792

(51) Int. Cl.[7] ..... D04B 35/12; D04B 35/14

(52) U.S. Cl. ..... 66/163; 139/370.2; 28/187; 242/485

(58) Field of Search ..... 139/370.2; 66/163; 28/187; 242/485, 534

(56) References Cited

U.S. PATENT DOCUMENTS 4,476,901 A 10/1984 Sainen
5,018,390 A * 5/1991 Muller ..... 28/187
5,136,499 A * 8/1992 Rydborn ..... 139/370.2
5,446,951 A * 9/1995 Takeuchi et al. ..... 139/370.2
6,148,872 A * 11/2000 Wahhoud et al. ..... 139/370.2

FOREIGN PATENT DOCUMENTS

FR 2 161 471 7/1973

* cited by examiner

*Primary Examiner*—John J. Calvert
*Assistant Examiner*—Robert H Muromoto, Jr.
(74) *Attorney, Agent, or Firm*—Flynn Thiel, Boutell & Tanis, P.C.

(57) ABSTRACT

A method and apparatus for monitoring run/stop conditions of a yarn, particularly in a knitting or warping machine utilizing a yarn feeler. The yarn feeler includes an electronic, yarn actuated transducer operating with variable gain amplification of run input signals which are further processed to final output signals representing the run/stop conditions. The amplification gain for the run input signal is automatically electronically controlled with a time delay and is adjusted towards a floating minimum which is just sufficient to derive stable final output signals. The, reaction time delay allows compensation for naturally occurring parametric fluctuations of the run input signal, while a sudden drop of the run input signal due to yarn breakage is processed to a final output stop signal.

11 Claims, 2 Drawing Sheets

METHOD AND APPARATUS FOR MONITORING RUN/STOP CONDITIONS OF A YARN

FIELD OF THE INVENTION

The invention relates to a method and apparatus for monitoring run/stop conditions of a yarn in a knitting or warping machine.

BACKGROUND OF THE INVENTION

In order to detect yarn breakage in textile machines, like knitting or warping machines, a yarn feeler is known which is able to output a logical final output signal indicating the run/stop conditions of a yarn actuating a transducer. A typical structure of a yarn feeler includes the transducer, a variable gain amplifier, a detector/comparator operating with a threshold in order to gain a detected run signal and an output filter operating with a predetermined time delay to output final output signals. The electrical run input signal of the transducer will mainly be generated on the basis of the yarn speed but also on the basis of other parameters like yarn tension, yarn linear specific mass, yarn count, yarn flexibility, yarn surface roughness, electrostatic charge of the yarn, etc. A variable gain amplifier is used because the amplification gain needs to be adjusted towards a minimum just assuring a stable output signal irrespective of parametric natural influences. A gain amplification which is too strong results in a poor time definition of the output and an output sensitive to spurious yarn motions simulated by external noise. A gain amplification which is too low results in an erratic output signal despite a correct run of the yarn. In the known yarn feeler the variable gain amplifier is adjusted manually. However, this is not well accepted by the users, because such empirical adjustment or trimming procedures are a waste of time and require particular skill, especially if a plurality of yarn feelers are installed at a machine. On the other hand, there is always a large risk that the adjustment is not carried out correctly.

It is an object of the invention to provide a method as disclosed and a yarn feeler which operates on the basis of this method, both leading to the highest quality of yarn monitoring, i.e. to avoid a poor time definition of the output signal, to achieve output signals insensitive to external noise, and to safely avoid an erroneously generated final output stop signal in case of a proper run of the yarn.

According to the method of the invention, the gain amplification permanently and automatically is adjusted to an optimum, namely a minimum just sufficient to ensure stable final output signals. No manual adjustments are necessary. Since the yarn feeler is adapting itself to an optimum sensitivity assuring stable final output signals, poor time definitions of the output signals and influences of external noises are avoided as well as an erroneously generated final output stop signal in case of properly running yarn. Said minimum is permanently adapted to instantaneously cope with all influencing parameters.

The yarn feeler does not need any manual trimming or adjustments since it automatically is seeking an optimum gain amplification. In knitting or warping machines having a plurality of such yarn feelers, the quality of each yarn feeler in view of its operation behaviour is enhanced significantly. The improved monitoring quality is achieved without the need for adjustment procedures carried out by operators. Of particular advantage is that a change of the yarn count or the yarn quality does not need any preparatory work at the yarn feelers since each yarn feeler has its own self-learning control adapting automatically to the instantaneous conditions and influencing parameters. The control strategy used is an automatic gain control technique interfering in a regulating fashion at the variable gain amplifier in order to maintain the final output signal within specified limits and independently of the amplitudes of the run input signal. A prerequisite is that the control band width is larger than the band width of the input run signal variation such that the control is able to follow these natural parametric variations. The control is operating with a constant reaction time. In order to avoid false output stop signals during normal run of the yarn, the output signals are filtered with a time delay slightly longer than the reaction time of the control. Said additional delay is acceptable for applications where yarn speed variations are moderate and also where the top speed of the yarn during the run is predeterminably moderate as on knitting or warping machines. Any type of electronic transducer can be integrated into the yarn feeler like piezo-electronic, electrostatic or other transducers. A final prerequisite of a correct function is that the band width of signals caused by yarn breakages is by far larger than the control band width. A yarn breakage will lead to an input run signal drop occurring much faster than the reaction time of the control so that a correct final output stop signal will result safely.

Particularly in knitting or warping machines, the natural parametric variations are slow enough, since the yarn starts its run with a mild acceleration, runs for a long time at essentially constant speed, until it then stops after a smooth deceleration. The slowness of the physical phenomenon provides enough time to adjust the gain amplification without the danger of generating false final stop signals, namely by filtering with an acceptable time delay prior to putting out the final output signal.

It is advantageous to compare the amplified run input signal with a predetermined threshold in order to output a detected run signal, on the basis of which the final output signal can safely be generated, but which simultaneously can be used to control the gain amplification such that the amplified run input signal is just higher than the threshold. As already mentioned, the mutually related band widths of the control and the natural variations of the run input signal allow the control to follow such variations in order to reliably achieve an essentially stable detected run signal, fluctuations of which are filtered by the output filter as long as such a fluctuation is not caused by a fast breakage drop.

According to a further aspect of the method, the variations of the gain amplification are controlled independently from the amplitudes, of the run input signal in order to keep the final output signal within specified limits.

Said AGC-control strategy can be carried out reliably and permanently by generating an amplification gain control signal on the basis of the detected run signal, to which amplification gain control signal the amplifier is responding by varying its amplification factor or sensitivity accordingly. As soon as the detected run signal shows the tendency to rise or to fall, the gain amplification will be lowered or raised accordingly.

Since in the case of a piezo-electric transducer almost all parameters originating from the yarn and its run are essentially constant, except the yarn tension decisive for the run input signal, the amplification gain control signal generated on the basis of the detected run signal is reflecting relatively precisely the control effort necessary to compensate for tension variations. Said interrelationship can be used to measure the instantaneous yarn tension.

In order to generate a reliable, logical, detected run signal or run/stop signal it could also be necessary to vary the detection threshold.

Since a final output stop signal also can occur within the correct operation cycle of the machine equipped with the yarn feeler, namely when the yarn is stopped as intended but not due to a yarn breakage, it is useful to evaluate the final output signals representing the run/stop conditions of the yarn in view of a sync-signal associated with normal or correct run/stop conditions. A final output stop signal-representing a yarn breakage leads to a stop of the machine when the associated sync-signal is indicating that the yarn should run.

In the yarn feeler it is advantageous to have a reaction time of the AGC-control strategy weak enough to compensate for natural parametrical fluctuation or spikes in the detected run signal, which fluctuations, as mentioned, occur slowly enough. Since to the contrary, a yarn breakage leads to a sudden drop of the yarn input signal, the then detected run signal cannot be maintained stable further on, and even the output filter cannot filter out said sudden drop, such that in the case of a yarn breakage a reliable final output stop signal will be generated.

The reaction time of the amplification gain control circuit ought to be adapted to the compensation of natural parametrical fluctuations.

Any type of transducer can be used for the yarn feeler. Of particular advantage are piezo-electric or electrostatic transducers which operate reliably and safely.

BRIEF DESCRIPTION OF THE DRAWINGS

Embodiments of the invention will be explained with the help of the drawings, in which.

DETAILED DESCRIPTION

Figure 1:
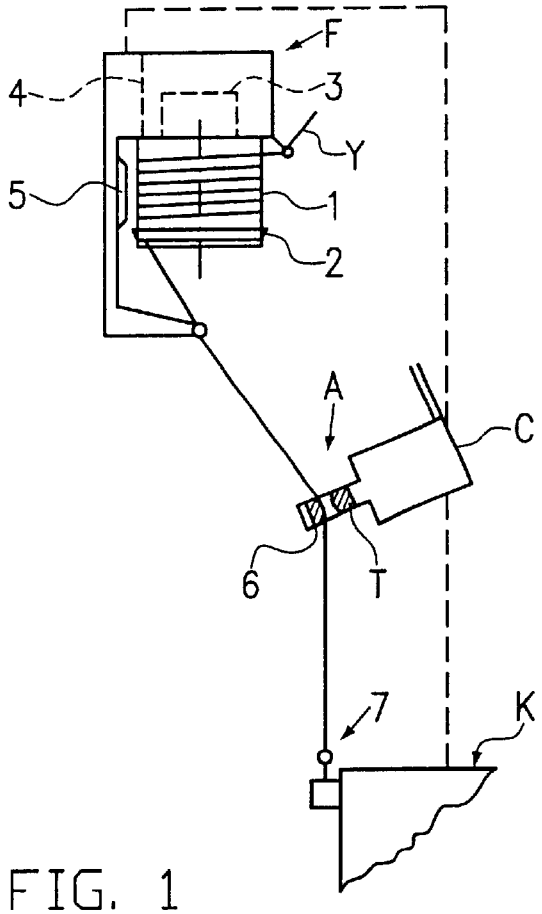
FIG. 1 shows a yarn supply and intake position of a knitting machine.

As an example of a yarn consuming textile machine in FIG. 1 a knitting machine K its shown, consuming a yarn Y intermediately stored at yarn feeder F. Yarn feeder F is equipped with rotatable storage body 1 carrying a braking ring 2, below which the yarn is withdrawn through an outlet eyelet and via a yarn feeler A into a knitting station 7 of knitting machine K. Yarn feeder F contains an electrical drive 3 controlled by a control unit 4 and sensors 5 monitoring the yarn store on storage body 1.

Yarn feeler A is equipped with yarn guide element 6 through which yarn Y while being withdrawn is deflected such that it actuates by its speed and/or tension an electronic transducer T apt to generate signals processed in a control circuit C. Yarn feeler A has the task to, e.g. stop knitting machine K and/or feeder F, in case that a yarn breakage has occurred. Furthermore, final output signals as provided by yarn feeler A have to reliably represent run/stop conditions of the yarn, e.g. in accordance with the operating cycle of the knitting machine or its sync-signal.

Figure 2:
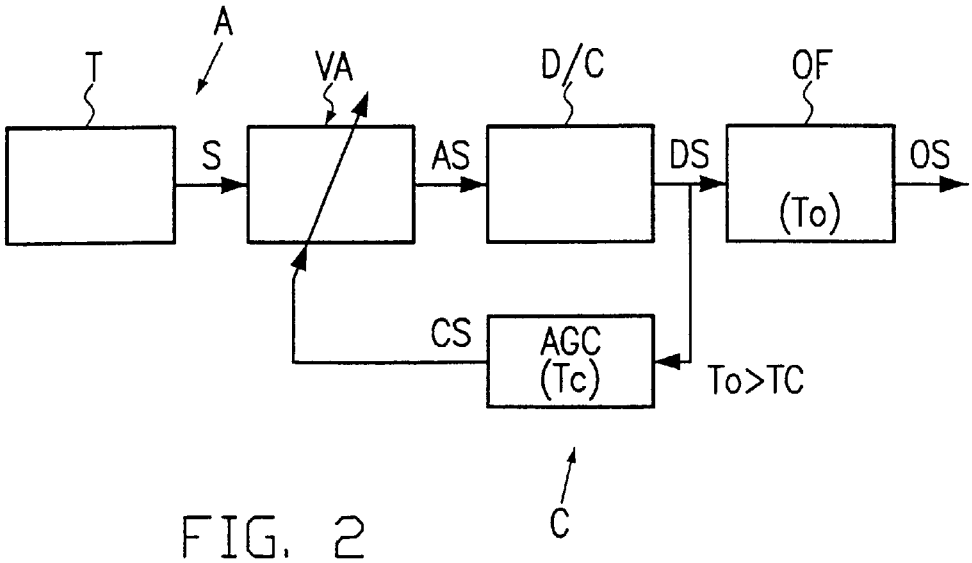
FIG. 2 shows a block diagram of a yarn feeler as used in FIG. 1.

Yarn feeler A with its control circuit C is depicted-in FIG. 2 in the form of a block diagram. The output of transducer T (e.g. a piezo-electric or electrostatic transducer) providing run output signal S is connected to a variable gain amplifier VA generating an amplified run output signal, AS in the form of a so-called "coloured" noise signal for a detector/comparator D/C, which in turn outputs a detected run signal DS. For this purpose detector/comparator D/C is operating with a predetermined threshold, i.e. detected run signal DS will be present with running yarn at the output of detector/comparator D/C as long as amplified output signal AS with its level is higher than the threshold. Detected run signal DS is finally filtered by output filter OF and is outputted in the form of a final output signal OS, i.e. either a final output run signal or a final output stop signal. Said final output signals will be considered, e.g. in the control unit or stop motion relay of the knitting machine and/or the feeder, e.g. in correlation to a so-called sync-signal indicating that the yarn Y from yarn feeder F should run or should not run. (A plurality of similar yarn feeders F may be arranged to feed several yarns to the knitting stations of knitting machine K, each having its own yarn feeler A.)

Furthermore, in the control circuit of yarn feeler A of FIG. 2, an amplification gain control circuit AGC is provided and connected to the adjustment inlet of variable gain amplifier VA and also to the output of detector/comparator D/C. Amplification gain control circuit AGC, e.g. in the form of a "blocked oscillator" (oscillation frequency e.g. about 2.5 KHz) is able to generate an amplification gain control signal CS for varying the gain amplification of variable gain amplifier VA or the respective amplification factor or the amplified output signal AS, respectively. The momentary value or level of detected run signal DS is used as a decisive parameter for the generation of amplification gain control signal CS. Amplification gain control circuit AGC is operating with constant reaction time Tc of about 40 ms. Similarly, output filter OF is operating with a predetermined constant time delay To e.g. about 50 ms. I.e., time delay To is at least slightly bigger than reaction time Tc.

The operation of yarn feeler A will be described with the help of FIGS. 2 and 3. Prerequisites for a proper operation of yarn feeler A is the already mentioned difference between To and Tc. Furthermore, the control band width has to be broader than the band width of any natural parametric variations of the run input signal S so that the AGC control will be able to follow these natural parametric variations. A yarn breakage is no natural parametric variation of the run input signal but will cause a run input signal decrease much faster than the reaction time Tc of the AGC circuit.

Figure 3:
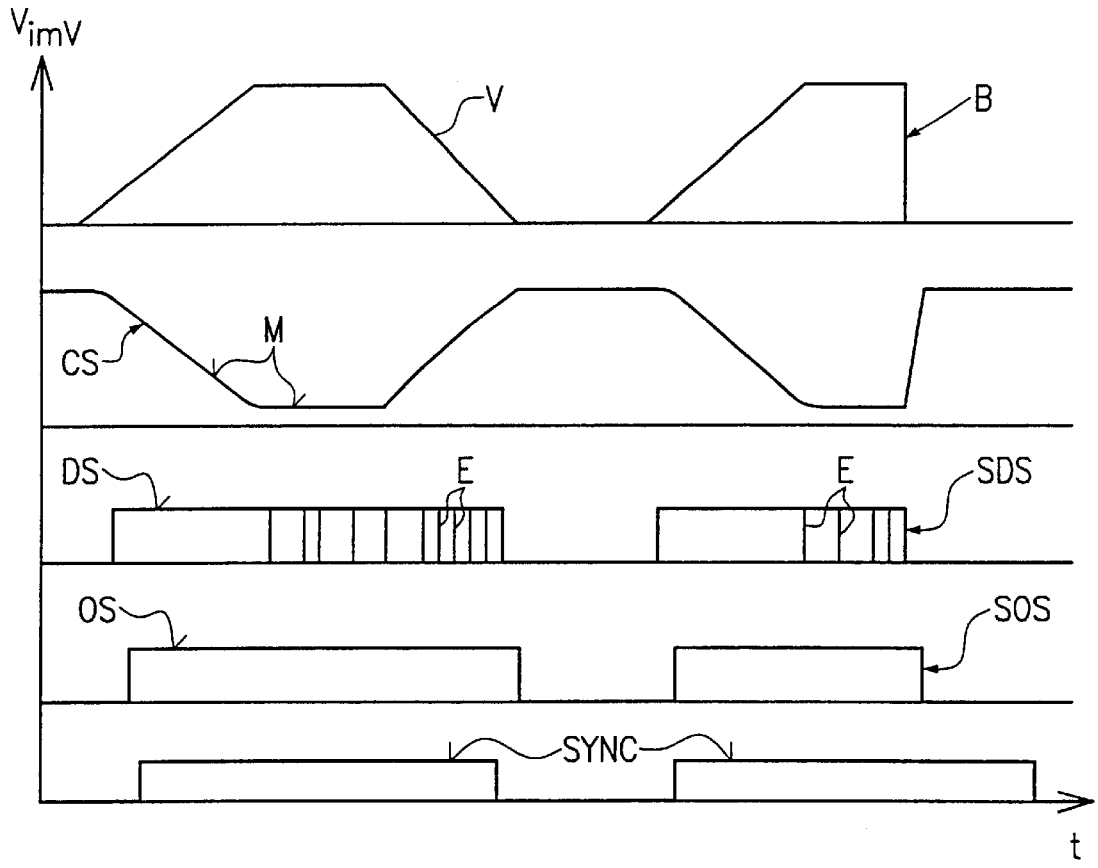
FIG. 3 shows several superimposed diagrams representing the method of operation of the yarn feeler.

As shown in the first upper diagram of FIG. 3, in a knitting machine the yarn is starting with weak acceleration, will then run for a long time at constant speed and will finally stop after a smooth deceleration, if no yarn breakage has occurred. In the second part of the curve in the first upper diagram the yarn again starts with moderate acceleration and then runs with essentially constant speed. However, in this case a yarn breakage B is occurring, meaning that the yarn speed is suddenly dropping to zero.

The second curve in FIG. 3 represents the amplification gain control signal CS as generated on the basis of or in order to stably maintain detected run signal DS (third diagram from the top). The second diagram from the top indicates that amplification gain control signal CS is controlled at a maximum when there is no yarn speed and varied indirectly proportional to the yarn speed behaviour. Actually, amplification gain control signal CS by the interference of AGC circuit and during the run of the yarn is adjusted to an optimum floating minimum M just sufficient to maintain a relatively stable detected run signal DS and also to assure a stable output signal OS (fourth diagram from the top). The most advantageous minimum of the sensitivity or the amplification gain in a certain point of time corresponds to a value with which a stable final output signal derived from the yarn speed and other parameters typical of the operating conditions will be generated, and for which minimum the final output signal remains insensitive to spurious yarn motions only simulated by external noise and where there is no danger that an erroneously final output stop signal can be generated even though the yarn is running correctly. As already stated, signal CS is modulated essentially inversely proportional to the run input signal S or the speed profile of the yarn and so that the amplified run output signal AS always will remain just above the threshold as considered in detector/comparator D/C resulting in the signal chain DS, namely the detected run signal DS in the third diagram from the top.

AGC circuit is operating with the above-mentioned reaction time Tc since parametric natural fluctuations cannot be avoided during the run of the yarn. Such fluctuations might cause spikes E in the signal chain of DS, resulting from the fact that the amplification gain control is compensating for such signal fluctuations upon their occurrence and with reaction time Tc. However, since such spikes E will be compensated for in a time shorter than time delay To of the output filter OF, the finally generated output run signals OS will be stable and without any spikes and will allow one to reliably judge the run/stop conditions of the monitored yarn.

The lowest diagram in FIG. 3 is indicating the so-called sync-signal, namely a signal as e.g. emitted by the control unit of the knitting machine and indicating, e.g. for the respective yarn feeder or even the control circuit C of the yarn feeler A when the yarn should run and when not.

If, as shown in the upper diagram, left-side, the yarn is decelerated to stand still as. required by the sync-signal, the end of detected run signal DS occurring in correspondence with the standstill of the yarn will result in final output stop signal (right-end flank of the left signal chain OS) which, however, will not be considered as being critical, e.g. in the control unit of the knitting machine, since this is only a confirmation of an expected stop condition of the yarn as required by the drop of the sync-signal.

When, however, as shown in the right curve of the upper diagram in FIG. 3 (V dropping due to yarn breakage B) the signal drop is occurring so fast that the amplification gain control signal CS is unable to follow and to compensate for this sudden signal drop, the amplified output signal AS will not reach the threshold so that the detected run signal DS will drop accordingly at SDS leading, due to time delay To of output filter OF, to a somewhat delayed final output stop signal SOS of signal chain OS. Since at this point in time sync-signal (lowest diagram in FIG. 3) still is present indicating that the yarn actually still should run, the control unit of knitting machine K immediately recognises final output stop signal SOS as an indication of yarn breakage B and will switch off the knitting machine and/or the feeder.

The applied AGC-control strategy must not allow false final stop signals during the normal operation. Unavoidable, natural signal fluctuations also must not generate a false stop. This is achieved by filtering the detected run signal DS for a time delay To slightly longer than the reaction time Tc of the AGC-circuit. However, this added delay To is acceptable in case of knitting or warping machines operating with relatively slow natural parametric variations, because the slowness of the physical phenomena gives enough time to adjust the sensitivity or the gain amplification by the AGC-control strategy and to avoid the generation of false final stop signals by filtering the detected run output signal DS with said acceptable time delay To prior to output. Furthermore, (second diagram from the top in FIG. 3) the amplification gain control signal CS in case of a piezoelectric transducer T, where all yarn parameters are essentially constant, except the yarn tension, also is actually a measurement of the control effort to compensate tension variations. As such CS can be taken to measure or monitor even the yarn tension.

Although a particular preferred embodiment of the invention has been disclosed in detail for illustrative purposes, it will be recognized that variations or modifications of the disclosed method and apparatus, including the rearrangement of parts, lie within the scope of the present invention.

I claim:

1. A method for monitoring run/stop conditions of a yarn in a knitting or warping machine, the yarn traveling with a yarn speed profile varying between minimum and maximum speeds, said method comprising:

providing an electronic yarn feeler including a yarn actuated transducer in contact with the yarn so as to generate a run input signal representing a yarn speed profile of the yarn;

operating the transducer with variable gain amplification of the run input signal;

starting from a predetermined minimum yarn speed-related maximum, permanently and automatically electronically controlling, with a constant reaction time delay, the amplification gain for the run input signal so as to be inversely proportional to the yarn speed profile and adjusting the amplification gain towards a floating minimum just sufficient to provide a stable final output signal;

compensating for natural parametric fluctuations of the run input signal with the reaction time delay while processing a sudden drop of the run input signal due to yarn breakage to a final output stop signal; and constantly evaluating the momentary final output signal in view of a simultaneously present sync-signal associated with expected run/stop conditions of the yarn and indicating when the yarn should run and when the yarn should not run.

2. The method of claim 1, including amplifying said run input signal into an amplified run output signal, permanently comparing the amplified run output signal to a predetermined threshold in order to achieve a detected run signal, and said adjusting of said amplification gain towards said floating minimum is carried out on the basis of said detected run signal such that said amplified run output signal is maintained just above said threshold in order to ensure a stable final output signal.

3. The method of claim 1, wherein said adjusting of said amplification gain towards said floating minimum is carried out with a band width larger than a band width of natural parametric variations of said run input signal but with a band width significantly narrower than band widths of run input signal variations caused by yarn breakage such that a control of said feeler follows natural parametric run input signal variations, but is unable to follow rapid variations caused by yarn breakage.

4. The method of claim 2, wherein said adjusting of said amplification gain towards said floating minimum includes generating an amplification gain control signal on the basis of said detected run signal.

5. The method of claim 2, including filtering said detected run signal with a time delay slightly larger than said time delay used for controlling said amplification gain to achieve a final output signal.

6. The method of claim 1, including generating said run input signal with a piezo-electric or electrostatic transducer which responds at least to speed and/or tension of the yarn in contact therewith.

7. The method of claim 4, including deriving the momentary yarn tension from said amplification gain control signal with a piezo-electric transducer which responds to yarn tension variations.

8. A yarn feeler for monitoring run/stop conditions of a yarn in a knitting or warping machine, the yarn traveling with a yarn speed profile varying between minimum and maximum speeds, said yarn feeler comprising:

a piezo-electric or electrostatic transducer for generating a run input signal upon contact actuation with the traveling yarn which is based on the speed and/or tension of the yarn;

an amplifier with variable amplification gain connected to said transducer for amplifying said run input signal into an amplified run output signal;

a detector/comparator for comparing said amplified run output signal with a detection threshold to generate a detected run signal;

an output filter connected to said detector/comparator for filtering said detected run signal with a time delay in order to output final output signals representing the run/stop conditions; and an amplification gain control circuit connected to said amplifier and to an output of said detector/comparator for generating an amplification gain control signal for adjusting the amplification gain towards a floating minimum on the basis of said detected run signal such that said output filter generates final output signals within specified limits, said amplification gain control circuit varying said amplification gain with a constant reaction time delay which is shorter than a time delay of said output filter.

9. The yarn feeler of claim 8, wherein said time delay of said amplification gain control circuit compensates for natural parametric fluctuations of said run input signal or of said detected run signal.

10. The yarn feeler of claim 8, wherein said amplification gain control circuit maintains said amplified run output signal just above said detection threshold to ensure stable final output signals.

11. The yarn feeler of claim 8, wherein said amplification gain control circuit operates with a band width larger than a band width of naturally-occurring parametric variations of said run input signal but smaller than band widths of run input signal variations caused by yarn breakage.

* * * * *